US006213044B1

(12) United States Patent
Rodgers et al.

(10) Patent No.: US 6,213,044 B1
(45) Date of Patent: Apr. 10, 2001

(54) WATER CRAFT WITH ADJUSTABLE FIN

(76) Inventors: John M. Rodgers, 5-5487 Kuhio Hwy., Hanalei, HI (US) 96714; John Collins, 4000 Old Dixie Hwy., Ormond Beach, FL (US) 32174

( * ) Notice: Subject to any disclaimer, the term of this patent is extended or adjusted under 35 U.S.C. 154(b) by 0 days.

(21) Appl. No.: 09/499,843

(22) Filed: Feb. 7, 2000

(51) Int. Cl.[7] ..... B63H 25/00
(52) U.S. Cl. ..... 114/152; 441/79
(58) Field of Search ..... 441/74, 79, 126, 441/127, 140; 114/127–143, 152

(56) References Cited

U.S. PATENT DOCUMENTS

| | | |
|---|---|---|
| 4,421,492 | 12/1983 | Leva . |
| 4,493,665 | 1/1985 | Liddle . |
| 4,733,496 | 3/1988 | Wallner . |
| 4,854,904 | 8/1989 | Wahl . |
| 5,070,804 | 12/1991 | Strazzeri . |
| 5,133,681 | 7/1992 | Lobe . |
| 5,176,096 | 1/1993 | Molnar et al. . |
| 5,356,324 | 10/1994 | Cunningham et al. . |
| 5,493,989 | 2/1996 | Anderson . |
| 5,567,190 | 10/1996 | Oates . |
| 5,649,846 * | 7/1997 | Harper et al. ..... 441/79 |

OTHER PUBLICATIONS

Magazine advertisement featuring various FCS/Fin Control Systems fins.
Magazine advertisement featuring The Surfer/Shaper.

* cited by examiner

*Primary Examiner*—Jesus D. Sotelo
(74) *Attorney, Agent, or Firm*—Holland & Knight LLP; David G. Maire, Esq.; James H. Beusse, Esq.

(57) ABSTRACT

A water craft having an adjustable fin assembly. The fin includes a base having a circular cross-section for rotating within a circular recess formed in a fin box attached to a water board. A means is provided for securing the fin at a predetermined angle of attack. The fin may be secured by a set screw or pin passing through the fin box and making contact with the base. The pin may pass through a hole in the base to provide vertical and rotational support for the fin. The pin may be moved between an engaged position and an unengaged position by the rotation of a gear interfacing with teeth formed on the pin. The fin base and fin box may include mating projections and slots for securing the angular position of the fin and an associated pin for retaining the fin within the fin box.

33 Claims, 4 Drawing Sheets

WATER CRAFT WITH ADJUSTABLE FIN

BACKGROUND OF THE INVENTION

This invention relates generally to water craft, and more particularly to a water board craft having a fin that is adjustable to a plurality of angular positions with respect to the direction of travel of the water craft. This invention is particularly useful when applied to a surfboard or sailboard to allow the rider to adjust the performance of the board to adapt to changing surf conditions and to variations in the weight and skill level of the rider.

Water board craft are well known in the art, taking the form of surfboards, sailboards, boogie boards, and other similar water craft that are maneuvered by the shifting of the weight of the rider. Such water craft typically include a board, formed of a strong yet buoyant material or combination of materials, and one or more fins attached to the bottom of the board. The fins provide stability to the board as it moves through or is propelled through the water. It has been long recognized that an adjustably mounted fin may provide improved performance by allowing the rider to adapt the board to varying conditions.

U.S. Pat. No. 5,493,989 issued to Anderson on Feb. 27, 1986, teaches an adjustable fin box system wherein the fin may be adjusted in the vertical, horizontal and angular directions. However, the angular freedom of movement provided by the Anderson device is about a horizontal axis, providing adjustment of the fin angle along the longitudinal axis of the board. The device of Anderson provides no freedom of movement for the fin about a vertical axis to adjust the fin angle with respect to the direction of movement of the board through the water.

U.S. Pat. No. 4,854,904 issued to Wahl on Aug. 8, 1989, teaches a sailboard with an adjustable keel mechanism. The Wahl device is designed to allow the keel to pivot about a vertical axis during the use of the board in response to loads imposed against the keel by the water, thereby eliminating crabbing and improving the speed of the board. The Wahl device does not provide the desired security of position of a fin in a variety of predetermined angular position.

U.S. Pat. No. 5,567,190 issued to Oates on Oct. 22, 1996, teaches another fin box assembly for a surfboard that permits the fin to be adjusted within an elongated fin box attached to a board. While the Oates device does provide for adjustment of the fin about a vertical axis, the range of adjustment is limited by the width of the fin box. Furthermore, the security of the fin position depends upon a friction interference between parts. These features may limit the usefulness of the Oats device and reduce its dependability in real world conditions.

BRIEF SUMMARY OF THE INVENTION

Thus there is a particular need for a water board craft having a fin that can be securely adjusted to a wide variety of angular positions with respect to the direction of travel of the board through the water. The mechanism used to adjust the fin should be easy to manufacture, simple to operate, and able to resist the large forces imposed on the fin during the use of the board craft.

A water craft is described herein including: a board; a fin box attached to the board, the fin box comprising a recess having a circular cross-section in a plane perpendicular to an axis of rotation; a fin having a base with a circular cross-section inserted within the recess, the fin being rotatable within the recess about the axis of rotation; and a means for securing the fin at any of a plurality of angles of rotation about the axis of rotation. The means for securing the fin may be as simple as a set screw in contact with a groove in the base, or as robust as a plurality of splines and slots formed in the base and fin box respectively along with a pinned connection between the board and the base.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
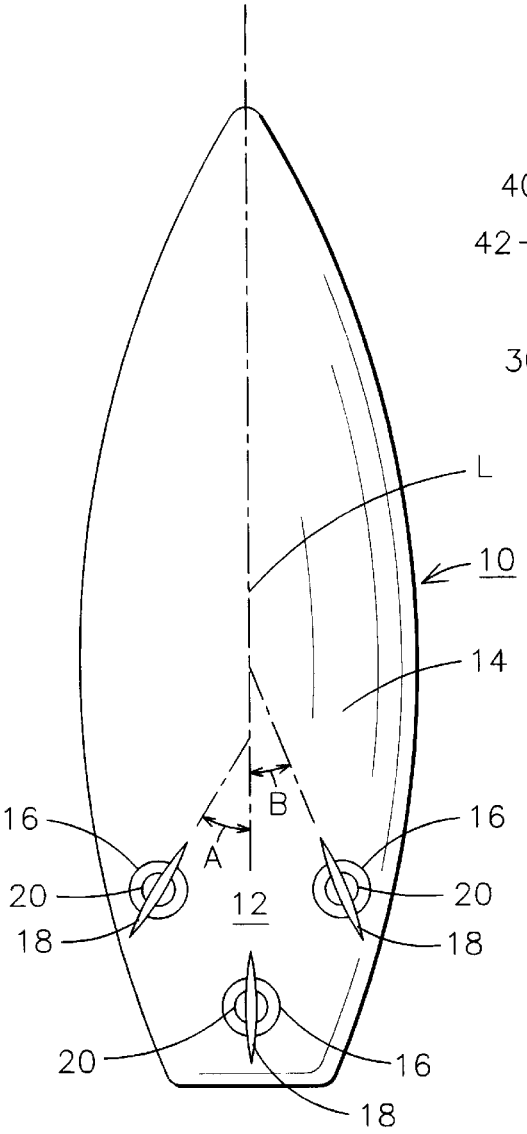
FIG. 1 is a bottom view of a water craft incorporating a plurality of adjustable fins.

FIG. 1 illustrates one embodiment of a water craft incorporating the present invention. Surfboard 10 is shown from a bottom view to review three adjustable fin assemblies 12 protruding from a bottom surface of board 14. Each adjustable fin assembly 12 includes a fin box 16 attached to the board 14 and a fin 18 having a base 20. The surfboard 10 moved through the water along its longitudinal axis L, and each fin assembly 12 is independently adjustable to vary the angle of attack of the respective fin 18 with respect to the longitudinal axis L, as illustrated by angles A and B.

Figure 2A:
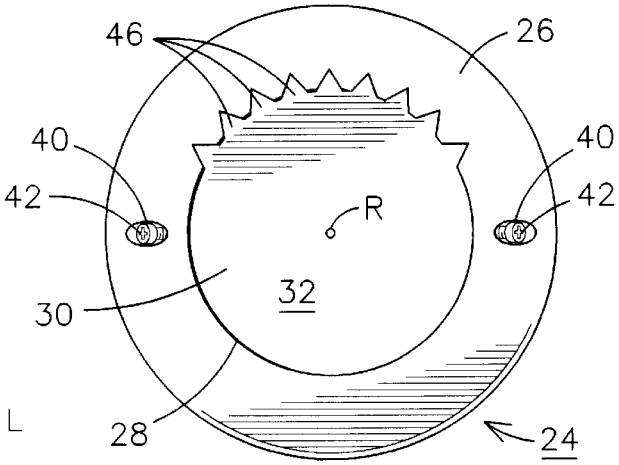
FIG. 2A is a top view of a fin box.
Figure 2B:
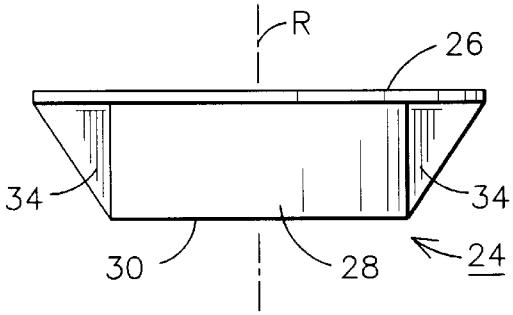
FIG. 2B is a side view of the fin box of FIG. 2A.
Figure 2C:
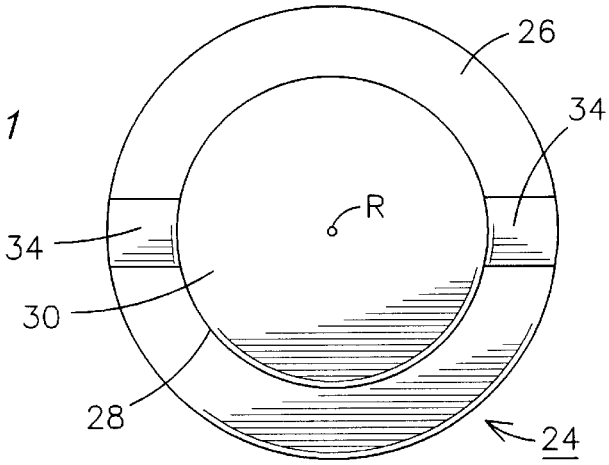
FIG. 2C is a bottom view of the fin box of FIG. 2A.

FIGS. 2A, 2B and 2C are top, side and bottom views respectively of one embodiment of a fin box 24 as may be used as fin box 16 in FIG. 1. Fin box 24 includes an upper flange 26 that is preferably installed to be flush with the bottom surface of board 14. A tubular shaped side portion 28 and a generally flat bottom 30 define a recess 32 having a circular cross-section in a plane perpendicular to an axis of rotation R. Reinforcing ribs 34 are formed between the upper flange 26 and the side portion 28 in two locations, although it may be appreciated that any number of such reinforcing ribs 34 may be used. The fin box 24 may be formed of plastic, fiberglass, metal or other material selected for its formability, strength and cost, and may be formed as a single integral piece or as individual sections joined with an adhesive or other fastening technique as may be known in the art. The fin box 24 is installed into the board 14 and secured with adhesive or fasteners. In one embodiment, a cap (not shown) is attached to the top of upper flange 26 to cover recess 32 during the process of glassing the board 14. In the glassing process, resin is spread over the surface of the board 14 and at least partially over the cap and proximate upper flange 26. The resin is then allowed to cure and is subsequently sanded smooth. During the sanding step, the cap is sanded off, thereby exposing recess 32 and forming a smooth glassed surface along the top of the board 14 and the top surface of the upper flange 26.

Figure 3A:
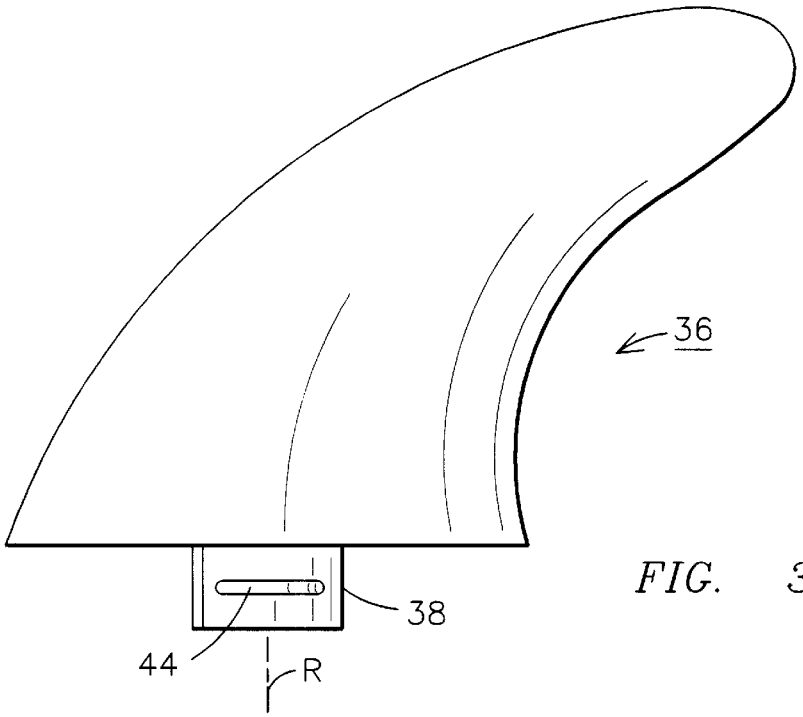
FIG. 3A is a side view of a fin.
Figure 3B:
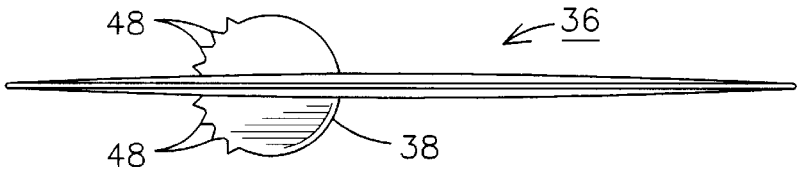
FIG. 3B is a top view of the fin of FIG. 3A.

FIGS. 3A and 3B are side and top views respectively of a fin 36 as may be used as fin 18 in FIG. 1. Fin 36 has a base 38 with a circular cross-section that is operable to be inserted into recess 32 of fin box 24. The mating dimensions of the fin 36 and recess 32 may be controlled to assure a snug fit while allowing the rotation of fin 36 about the vertical axis of rotation R after the base 38 is installed into recess 32. In one embodiment the mating dimensions may be held to provide a gap of only about 0.005–0.020 inch between the parts, thereby assuring that friction alone will secure the fin base 38 within the recess 32. Preferably, some form of releasable fastener is used to secure the fin 36 at any of a plurality of angles of rotation about the axis of rotation R. FIGS. 2A and 3A illustrate one embodiment of such a means for securing the fin. One or more threaded holes 40 are formed in the reinforcing web 34 to open on the top of upper flange 26 and into recess 32. A set screw 42 is disposed in each hole 40 in threaded engagement with the fin box 24 and, when fully inserted, extending into the recess 32 to be in contact with the base 38. One or more grooves 44 may be formed in base 38 to provide better contact with the screw 42. If additional security is needed for maintaining fin 36 in a predetermined angular position relative to the axis of rotation R, a plurality of slots 46 may be formed in fin box 24 for receiving a plurality of projections 48 extending from the circular cross-section of base 38. This arrangement permits the fin base 38 to be inserted into the recess 32 at any one of a predetermined plurality of angles of rotation about the axis of rotation R by alignment of the projections 48 with predetermined respective ones of the slots 46. The angular extent of the slots 46 around the perimeter of recess 32 can be varied depending upon the desired range of adjustment of fin 36.

Figure 4:
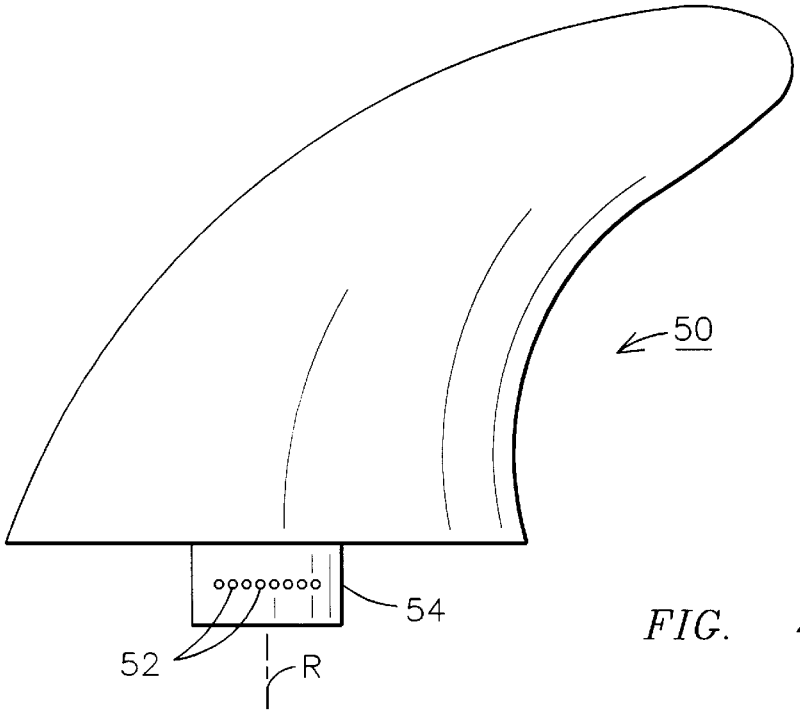
FIG. 4 is a side view of a second embodiment of a fin.
Figure 5:
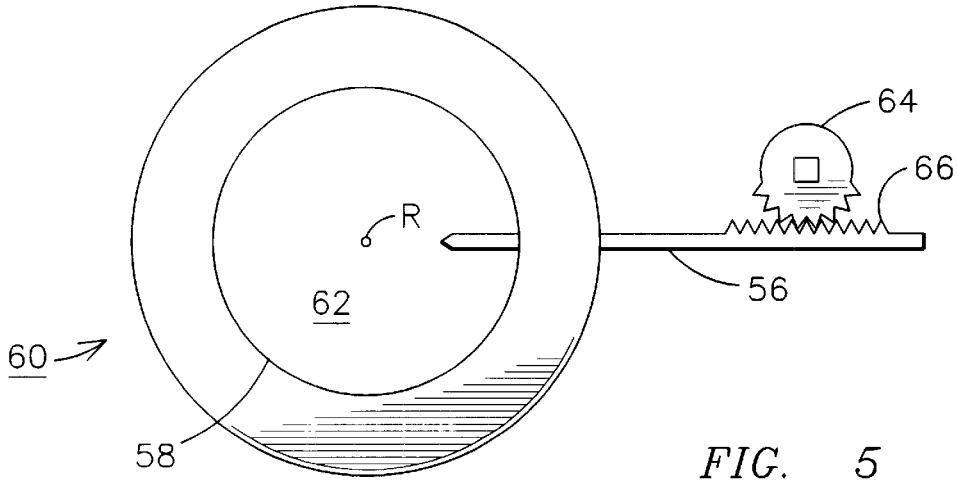
FIG. 5 is a top view of a second embodiment of a fin box having an associated pin and gear fastening mechanism.

FIG. 4 illustrates a side view of another embodiment of a fin 50. In this embodiment, a plurality of holes 52 are formed in base 54. As can be seen by viewing FIGS. 4 and 5 together, these holes are operative to receive a pin 56 moveable attached to the board 14 and passing through a side portion 58 of fin box 60. With pin 50 withdrawn from recess 62, fin 50 may be inserted into recess 62 in any predetermined one of a plurality of angles about axis of rotation R so that pin 56 is in alignment with a corresponding one of holes 52. Pin 56 is then inserted through the selected hole 52 into recess 58, thereby providing preventing both vertical and rotational relative movement between fin 50 and fin base 60. Pin 56 may be moved between the engaged and disengaged positions by any variety of mechanisms, for example, by the rotation of gear 64 interfacing with corresponding threads or teeth 66 formed on pin 56.

Figure 6:
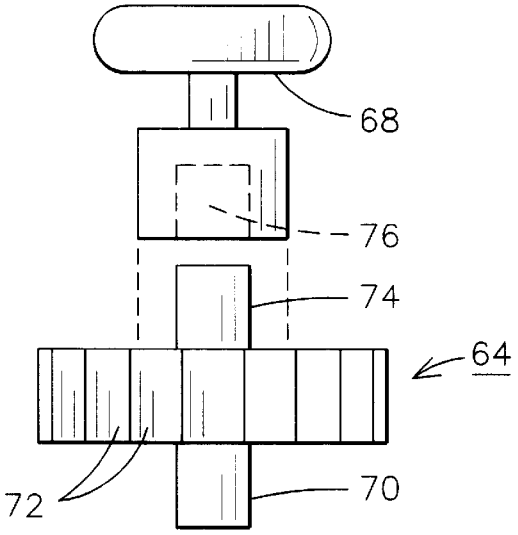
FIG. 6 is a side view of the gear of FIG. 5 showing its operative relationship with a key.

FIG. 6 is a side view of gear 64 showing its mating relationship with a key 68 used to manually rotate gear 64. Gear 64 has a shaft portion 70 rotatably affixed to board 14, and threads or teeth 72 for mating with corresponding threads or teeth 66 on pin 56. A shank portion 74 is formed to mate with a correspondingly shaped recess 76 formed in key 68. The use of a key 68 allows the top of gear 64 to be maintained flush with or below the surface of board 14, thereby ensuring the safety of the rider and a clean aerodynamic shape for the board surface. It may be appreciated that other means for moving and securing the pin 56 may be used, such as a latch mechanism having a handle that lays flat with the surface of the board 14 when not in use. It may be further appreciated that in lieu of the use of holes 52 in fin 50, pin 56 may be allowed to simply apply compressive force against base 54, or to interface with a groove, such as groove 44, formed in base 54. Once in the engaged position, pin 56 may be restrained from movement simply by the friction fit between the pin and nearby structures, by a spring device (not shown) interfacing with the teeth 72,66, or by a cap that snaps over shank portion 74 and fits securely into a recess in board 14.

Figure 7:
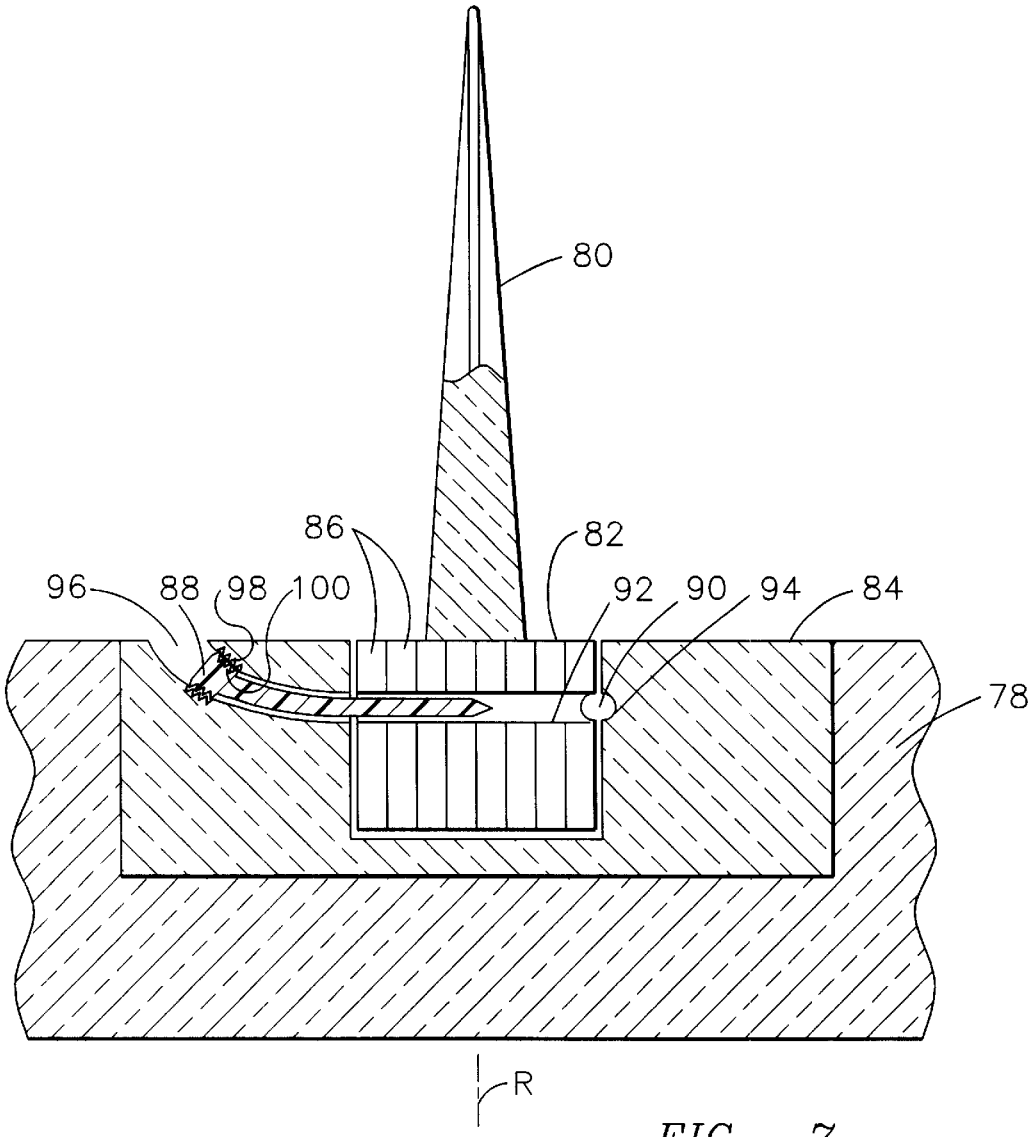
FIG. 7 is a partial sectional view of a fin installed in a fin box.

FIG. 7 illustrates a partial cross-sectional view of another embodiment of a water craft built in accordance with this invention. A fin 80 having a base 82 is secured into a fin box 84 glued or otherwise secured in a bottom portion of a board 78. The fin base 82 may be splined with a plurality of projections 86 that interface with corresponding slots (not shown) formed in fin box 84. Alternatively, the mating surfaces of the base 82 and fin box 84 may be smooth. Fin 80 may be inserted into fin box 84 at any of a predetermined angular positions about axis of rotation R. The interaction of the projections 86 and slots precludes angular movement of the fin 80 relative to the fin box 84. Relative vertical movement of these parts along axis of rotation R is precluded by the insertion of retainer 88 into groove 90 formed by matching grooves 92,94 formed in fin base 82 and fin box 84 respectively. Retainer 88 is in threaded engagement with fin box 84 for insertion through passageway 96. Once fin 80 is inserted into fin box 84, retainer 88 is inserted into passageway 96 and tightened into position by mating threads 98,100. Retainer 88 is formed of a flexible material, such as plastic or hard rubber, to allow it to be inserted along the curved path of groove 90. In one embodiment, retainer 88 extends along about 30 degrees of the circumference of base 82. The contact between retainer 88 and groove 92 restrains the relative movement of fin 80 and fin box 84 along axis of rotation R. If no projections and slots are provide on the mating surfaces of the base 82 and fin box 84, the friction generated between the retainer 88 and the base 82 and fin box 84 may also serve to restrain relative motion between these parts around axis of rotation R.

Figure 8:
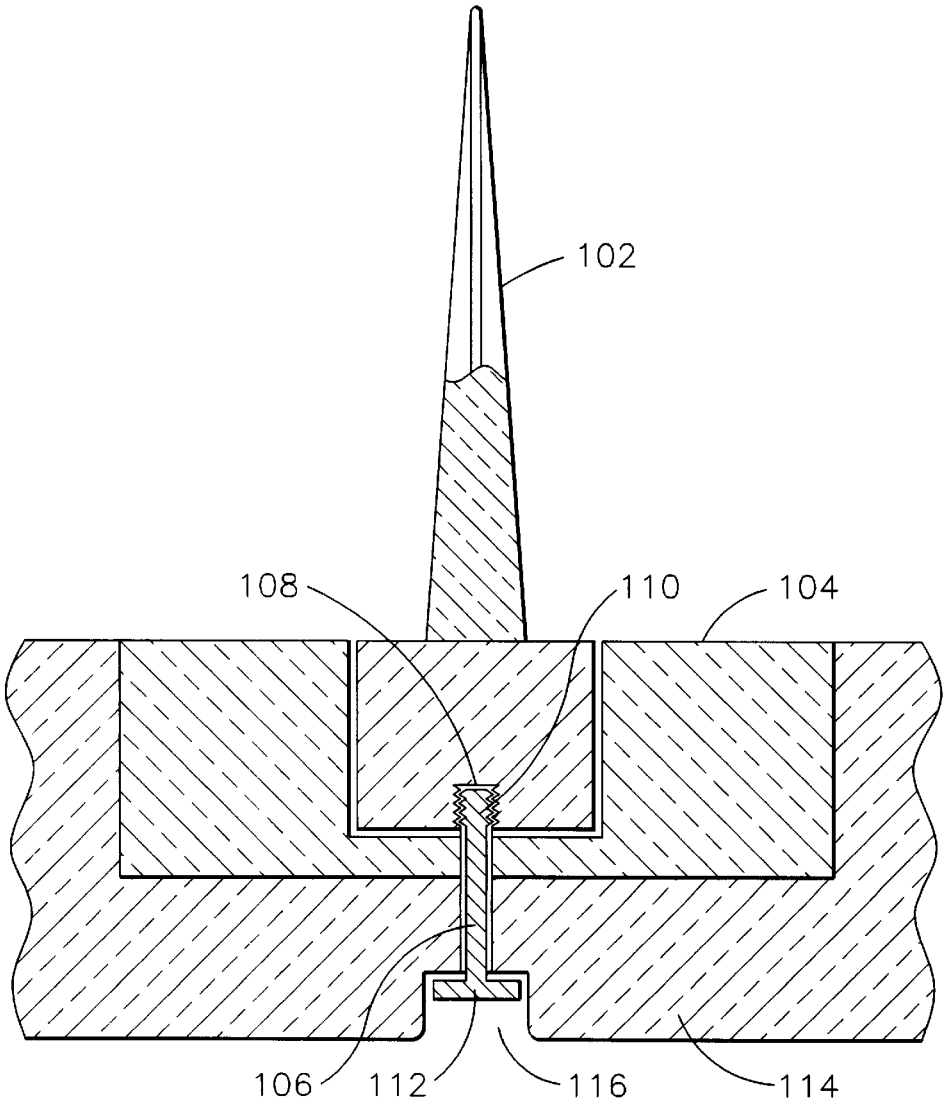
FIG. 8 is a partial sectional view of a fin installed in a fin box and secured by a fastener.

FIG. 8 illustrates an embodiment similar to that of FIG. 7 except that fin 102 is secured vertically in fin box 104 by a fastener such as screw 106. Fin 102 is formed to include a threaded opening 108 for engagement with respective threads 110 formed on screw 106. Screw 106 also includes a head 112 that is in contact with the top surface of water board 114 within recess 116. Screw 106 resists the vertical relative movement between the fin 102 and fin box 104, and it may also provide all or a portion of the restraint against relative angular movement between these parts.

Fin boxes 24,60 define a recess 32,62 in the bottom surface of board 14. Other embodiments of this invention may forgo the use of a separate fin box, but rather make use of a recess having a circular cross-section formed directly into board 14. Such a recess may be formed by drilling a hole in the board 14 or by forming a side wall directly in the board shape during fabrication of the board 14. If a set screw 42 or pin 56 is used as a fastener for such an embodiment, a hole would be formed directly into the board 14 and extending into the recess for passage of the screw or pin.

The adjustable fin of the present invention may be installed on an existing water craft as an upgrade. Existing fins may be removed, as appropriate, and an adjustable fin assembly 12 installed by known board repair/fabrication steps including drilling, gluing, and sanding. A kit for such an upgrade operation may include a fin box 24, one or more screws 42, and a fin 36. Kits may be packaged for installing any of the described embodiments of the invention, including appropriate tools such as key 68 or an appropriate Allen wrench for moving the screw 42 from the engaged position to the disengaged position.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A water craft comprising:

a board;

a fin box attached to the board, the fin box comprising a recess having a circular cross-section in a plane perpendicular to an axis of rotation;

a fin base having a base with a circular cross-section inserted within the recess, the fin base being rotatable within the recess about the axis of rotation; and a means for adjustably securing the fin at any of a plurality of angles of rotation about the axis of rotation.

2. The water craft of claim 1, wherein the means for securing the fin comprises:

a threaded hole formed in the fin box and opening into the recess;

a screw disposed in the hole in threaded engagement with the fin box and extending into the recess and in contact with the base.

3. The water craft of claim 2, further comprising a groove formed in the base, and wherein the screw is in contact with the groove.

4. The water craft of claim 3, further comprising:

a plurality of projections formed on the base; and a plurality of slots formed in the fin box for receiving the plurality of projections.

5. The water craft of claim 1, further comprising:

a plurality of holes formed in the base;

a hole formed in the fin box extending into the recess; and a pin disposed through the hole in the fin box and one of the plurality of holes in the base.

6. The water craft of claim 5, further comprising a means for moving the pin from an engaged position extending into one of the plurality of holes to a disengaged position withdrawn from the plurality of holes.

7. The water craft of claim 1, wherein the means for securing comprises:

a hole formed through the board and fin box; and a fastener passing through the hole and in engagement with the base.

8. The water craft of claim 1, wherein the means for securing comprises:

a groove formed between the fin box and the base; and a retainer inserted into the groove.

9. A water craft comprising:

a fin having a base with a generally circular cross-section and a plurality of projections extending therefrom;

a board;

a fin box attached to the board, the fin box comprising a recess having a generally circular cross-section in a plane perpendicular to an axis of rotation and having a plurality of slots formed therein for receiving the respective plurality of projections;

wherein the fin base is insertable into the recess at any predetermined one of a plurality of angles of rotation about the axis of rotation by alignment of the projections with predetermined respective ones of the slots.

10. The water craft of claim 9, further comprising:

a groove formed in the base; and a set screw in threaded engagement with the board and operable to be screwed into the groove for retaining the base within the recess.

11. The water craft of claim 9, further comprising:

a groove formed in the base; and a pin moveably disposed through a hole formed in the fin box and operable to be inserted into the groove for retaining the base within the recess.

12. The water craft of claim 11, further comprising:

threads formed on the pin; and a gear rotatably attached to the board and in engagement with the threads, whereby rotation of the gear causes movement of the pin into the groove.

13. The water craft of claim 12, further comprising a key operable to be engaged with the gear for manually rotating the gear.

14. The water craft of claim 9, further comprising:

a plurality of holes formed in the base;

a pin moveably disposed through a hole formed in the fin box and operable to be inserted into a predetermined one of the plurality of holes formed in the base.

15. The water craft of claim 9, further comprising a means for retaining the base within the recess.

16. The water craft of claim 9, further comprising:

a groove formed in the fin base;

a retainer attached to the fin box and in contact with the groove for resisting relative movement between the fin and the fin box along the axis of rotation.

17. The water craft of claim 16, wherein the retainer is in threaded engagement with the fin box.

18. The water craft of claim 9, further comprising:

a fastener in contact with the board and in threaded engagement with the fin base for resisting relative movement between the fin and the fin box along the axis of rotation.

19. The water craft of claim 9, further comprising:

a hole formed through the board and fin box; and a fastener passing through the hole and in engagement with the base.

20. The water craft of claim 9, further comprising:

a groove formed between the fin box and the base; and a retainer inserted into the groove.

21. A water craft comprising:

a board;

an opening formed in a bottom surface of the board, the opening having a circular cross-section in a plane perpendicular to an axis of rotation;

a fin having a base with a circular outside surface inserted within the circular opening, the fin base being rotatable within the opening about the axis of rotation; and a fastener for adjustably securing the fin base at any of a plurality of angles of rotation about the axis of rotation.

22. The water craft of claim 21, further comprising a threaded hole formed in the board and extending into the opening; and wherein the fastener comprises a screw disposed in the hole and in threaded engagement with the board and extending into the opening in contact with the base.

23. The water craft of claim 21, further comprising:

a groove formed in the base;

a hole formed in the board and extending into the opening; and wherein the fastener comprises a pin disposed in the hole and extending into the opening in contact with the groove.

24. The water craft of claim 23, further comprising a means for moving the pin in the hole from an engaged position in contact with the groove to a disengaged position withdrawn from the groove.

25. The water craft of claim 23, further comprising threads formed on the pin; and a gear rotatably attached to the board and in engagement with the threads, whereby rotation of the gear causes movement of the pin into the groove.

26. The water craft of claim 25, further comprising a key operable to be engaged with the gear for manually rotating the gear.

27. The water craft of claim 21, further comprising a plurality of holes formed in the base;

and wherein the fastener further comprises:

a hole formed in the board and extending into the recess; and a pin disposed in the hole and extending into one of the plurality of holes.

28. The water craft of claim 27, further comprising a means for moving the pin within the hole formed in the base from an engaged position extending into one of the plurality of holes to a disengaged position withdrawn from the plurality of holes.

29. A kit for upgrading a water craft, the kit comprising:

a fin box comprising a recess having a circular cross-section in a plane perpendicular to an axis of rotation;

a fin having a base with a circular cross-section inserted within the recess, the fin being rotatable within the recess about the axis of rotation; and a means for securing the fin at a plurality of angles of rotation about the axis of rotation.

30. A water craft comprising:

a board;

a fin box attached to the board and having a recess formed therein;

a fin having a base adapted for insertion into the fin box recess and rotatable therein about an axis of rotation; and a means for adjustably securing the fin base within the fin box recess at any of a plurality of angles of rotation about the axis of rotation.

31. The water craft of claim 30, further comprising:

a plurality of projections formed on the fin base; and a plurality of slots formed in the fin box for receiving the plurality of projections.

32. A water craft comprising:

a board;

a fin box attached to the board and having a recess formed therein;

a fin having a base adapted for insertion into the fin box recess and rotatable therein about an axis of rotation; and a fastener adapted adjustably to secure the fin base within the fin box recess at any of a plurality of angles of rotation about the axis of rotation.

33. The water craft of claim 32, further comprising:

a plurality of projections formed on the fin base; and a plurality of slots formed in the fin box for receiving the plurality of projections.

* * * * *